United States Patent [19]

Gregory

[11] Patent Number: 4,801,363

[45] Date of Patent: Jan. 31, 1989

[54] HIGH PURITY ALKALINE EARTHS VIA ELECTRODEPOSITION

[75] Inventor: Thomas D. Gregory, Midland, Mich.

[73] Assignee: The Dow Chemical Company, Midland, Mich.

[21] Appl. No.: 501

[22] Filed: Jan. 5, 1987

[51] Int. Cl.[4] ..... C25D 11/08

[52] U.S. Cl. ..... 204/58.5

[58] Field of Search ..... 204/58.5; 75/101, 67 R, 75/67 A

[56] References Cited

U.S. PATENT DOCUMENTS

| | | | |
|---|---|---|---|
| 2,615,838 | 10/1952 | Minnick et al. | 204/59 |
| 3,131,134 | 4/1964 | Micillo | 204/14 |
| 3,355,368 | 1/1988 | Smith et al. | 204/14 |
| 3,520,780 | 7/1970 | Findl et al. | 204/3 |
| 3,898,097 | 8/1975 | Fraioli | 136/6 R |
| 4,071,415 | 1/1978 | Wong | 204/14 N |
| 4,152,220 | 5/1979 | Wong | 204/14 N |
| 4,187,350 | 2/1980 | McIntyre et al. | 429/45 |
| 4,378,273 | 3/1983 | Walsh et al. | 204/14 N |

OTHER PUBLICATIONS

Abner Brenner, "Note on the Electrodeposition of Magnesium from an Organic Solution of a Magnesium-Boron Complex," *J. Electrochem. Soc.*, 118(1), Jan. 1971, pp. 99-100.

Müller et al., Chem. Abs. 18:1229 (1924).

Müller et al., Chem. Abs. 20:1022 (1925).

Gillet & Bloyaert, Chem. Abs. 45:6093g (1951).

Chilton, Jr., Chem. Abs. 62:3665c (1965).

Brenner, Chem. Abs. 67:69927h (1967).

Japanese 80-10,677, Chem. Abs. 93:83655m (1980).

D. M. Overcash and F. C. Mathers, "The Electrodeposition of Magnesium," (1933).

Chem. Abs. 48:10453-54 (1954), especially 48:10453h.

Chem. Abs. 50, ed. 2321-22 (1956), especially 50:2321e-f.

Chem. Abs. 66:87774q-91030 (1967), especially 66:91019q.

Chem. Abs. 81, p. 532 (1974), especially 81:144571g.

Weast et al., (Eds.), CRC Handbook of Chemistry & Physics, 61st Edition, CRC Press, Inc., Boca Raton, Florida, B-115.

A. Brenner and J. L. Sligh, "Electrodeposition of Magnesium and Beryllium from Organic Baths," Transactions of the Institute of Metal Finishing, 1971, vol. 49, pp. 71-78.

Jean H. Connor, Walter E. Reid, Jr. and Gwendolyn B. Wood, "Electrodeposition of Metals from Organic Solutions," *J. Electrochem. Soc.*, vol. 104, No. 1, Jan. 1957, pp. 38-41.

*Primary Examiner*—R. L. Andrews

*Attorney, Agent, or Firm*—N. Jerome Rudy

[57] ABSTRACT

Included is a process for electrodepositing a high purity metallic containing alkaline earth metal on a conductive substrate comprising operating an electrochemical cell having (1) an anode selected from the group consisting of a passive anode and a sacrificial alkaline earth metal containing anode;

(2) an electrolyte containing an aprotic solvent and a solute of a minor amount of residual halogen containing synergist and a major amount of residual alkaline earth metal, and (3) a cathode, which contains the conductive substrate, under conditions whereby said electrodepositing occurs. For example, a most pure crystalline magnesium deposit can be prepared with tetrahydrofuran, aluminum trichloride and ethylmagnesium chloride, employing either an inert carbon, or a sacrificial magnesium containing, anode.

19 Claims, No Drawings

HIGH PURITY ALKALINE EARTHS VIA ELECTRODEPOSITION

FIELD

The invention concerns metallic substances containing substantial amounts of at least one alkaline earth metal, with a process for preparing same. These metallic substances are generally useful in alloys, as metals or chemical intermediates.

BACKGROUND

Certain electrochemical procedures for preparing certain alkaline earth metal containing materials are known. For example, Smith et al., U.S. Pat. No. 3,355,368 (1967) discloses electrodeposition of certain metals, preferably comprising aluminum, from certain nonaqueous plating baths. The plating bath is disclosed to be a certain aluminum halohydride and low percentage solvent ether composition. It may also contain a particular organic complex of an aluminum halide in order to improve thermal stability of the electroplating bath. Other metals that may be electrodeposited include beryllium and magnesium, with or without aluminum.

Walsh, IV et al., U.S. Pat. No. 4,378,273 (1983), discloses a certain process for preparing high surface area chemical pump absorbants for chemical lasers comprising electrodeposition of an alkali or alkaline earth metal, preferably calcium, onto a suitable conductive matrix from a certain nonaqueous electrolyte. The solvent of the electrolyte is also polar. Utile solvents therein include pyridine, N,N-dimethylformamide, formamide, acetamide, propylene carbonate and their mixtures and the like. The polar solvent dissolves alkali or alkaline earth metal salts, for example, calcium chloride, calcium chlorate, calcium nitrate and their mixures and the like.

Also, Findl et al., U.S. Pat. No. 3,520,780 (1970), discloses a certain method for magnesium electrodeposition. The method employs a certain initial amount of alkyl magnesium halide in tetrahydrofuran.

And, Brenner & Sligh, *Trans. Inst. Metal Finishing,* 49, 71–78 (1971) discloses certain electrodeposition of magnesium and beryllium from organic baths. It purports that the cathodic magnesium deposit from Grignard reagents, and also with complexed boranes, are each at least 99 percent pure, and that the beryllium deposits are 85 to 90 percent pure.

However, Conner; Reid, Jr. & Wood, *J. Electrochem Soc.,* 104(1), 38–41 (1957) earlier disclosed that diethyl ether is allegedly superior to tetrahydrofuran in appropriate organic plating baths and that the ether bath containing aluminum bromide, magnesium bromide and lithium aluminum hydride gives a magnesium to aluminum ratio of approximately 0.8:1 to yield a good alloy of 7 percent magnesium and 93 percent aluminum. With a ratio of magnesium to aluminum therein which is higher (for example, from 1.05:1 to 5.1:1), the deposit is reported to be from fair to very poor, respectively.

Fraioli, in U.S. Pat. No. 3,898,097 (1975) discloses a certain secondary power cell containing an alkali or alkaline earth metal. The cell is nonaqueous. But, said metals are typically present in a surface amalgamated form.

The art yet lacks a nonaqueous electrolyte electrochemical process which can prepare a very high purity alkaline earth metal. Such a process is desirable in the art because of the need for such metals and of the efficiency and general advance such a process may provide.

SUMMARY

The invention includes a process for electrodepositing a high purity metallic containing alkaline earth metal on a conductive substrate comprising operating an electrochemical cell having (1) an anode selected from the group consisting of a passive anode and a sacrificial alkaline earth metal containing anode;

(2) an electrolyte containing an aprotic solvent and a solute of a minor amount of residual halogen containing synergist and a major amount of residual alkaline earth metal, and (3) a cathode, which contains the conductive substrate, under conditions whereby said electrodepositing occurs. The invention is highly versatile, selective and efficient. It can prepare extremely high purity metallic substances such as, for instance, ranging from pure select alkaline earth metal alloy compositions to a most pure alkaline earth metal. For example, 99.99 percent pure magnesium can be prepared from relatively inexpensive sources such as, by way of illustration, magnesium alloy scrap or cell magnesium. The presence of the said synergist is of importance to the invention.

The high purity metallics containing alkaline earth metal are useful in structural alloys, as metals or chemical intermediates. For example, magnesium is a generally well known reactive metal which can be employed in lightweight metal alloys essential for modern airplane and missile construction, and which can be employed in flashlight photography, flares and pyrotechnics, including incendiary bombs, and which can also be an intermediate for medicines, for example, milk of magnesia, organometallic reagents, for instance, Grignard reagents, and so forth.

DETAILED DESCRIPTION

The high purity metallic which is electrodeposited in the process of the invention is a high purity substance such as a metal or select alkaline earth metal alloy. The metal is, of course, a generally solitary high purity alkaline earth metal. The select metal alloy is high purity combination of at least two alkaline earth metals. Deposit of the metal is preferred over deposit of the select metal alloy.

The alkaline earth metals are Beryllium (Be), Magnesium (Mg), Calcium (Ca), Strontium (Sr), Barium (Ba) and Radium (Ra). Preferred of these include Mg, Ca, Sr and Ba, specifically Mg.

Preferably, the high purity metal is at least 90 percent pure, more preferably at least 95 percent pure, more so at least 99 percent pure, even more so at least 99.9 percent pure, and most preferably, at least 99.95 percent pure. Advantageously, the high purity select metal alloy is at least about 95 percent pure, that is, contains at least about 95 percent of at least two alkaline earth metals. More advantageously it is at least about 99 percent pure, more so at least 99.7 percent pure. Even more desirably it is at least about 99.92 percent pure, while most advantageously it is at least 99.97 percent pure.

The purity is determined by elemental analysis. Any percentages therein are by weight. The determination of the purity is generally made exclusive of initially-present conductive substrate.

The anode can be a passive anode. The passive anode is one which does not generally interfere with the process of the invention. Preferably, the passive anode generally maintains its integrity in carrying out the process of the invention such as does graphite, that is, it is preferably generally inert.

The anode can be a sacrificial alkaline earth containing anode. The sacrificial alkaline earth containing anode generally decomposes during operation of the electrochemical cell. Preferably, the sacrificial alkaline earth containing anode provides at least some residual alkaline earth metal to the electrolyte which generally is electrodeposited onto the conductive substrate. Preferably, the satrificial alkaline earth containing anode contains alkaline earth metal. More preferably, it is of an alkaline earth metal of less purity than that which is electrodeposited onto the conductive substrate. Thus, the process of the invention can be an electrorefining process. So, not only can the sacrificial anode be one such as, for instance, an alloy of magnesium with non-alkaline earth component(s), but also can be any impure alkaline earth metal anode.

Of course, the anode can be a combination of passive and sacrificial alkaline earth containing components, which is typically considered such as a sacrificial anode in operation, albeit combined. However, the separate passive, or sacrificial alkaline earth containing, anode is preferred. More preferably, however, the anode is the separate sacrificial alkaline earth containing anode.

The electrolyte contains an aprotic solvent. Representative examples of the aprotic solvent include those such as tetrahydrofuran, 2-methyltetrahydrofuran, 1,4-dioxane, diethyl ether, 1,2-dimethoxyethane, diphenylether, ethylene carbonate, propylene carbonate, butyrolacetone, acetonitrile, formamide, dimethylformamide, N,N-dimethylaniline, dimethylsulfoxide, carbon disulfide, and so forth. Preferably, $C_{2-20}$ (from two to about twenty carbon) ether(s) is (are) employed, and more preferably the ether is $C_{4-8}$ (from four to about eight carbon) alkyl ether. Specifically preferred is tetrahydrofuran (THF).

The electrolyte also contains the solute component. The solute component contains the minor amount of residual halogen containing synergist and the major amount of residual alkaline earth metal.

The residual halogen containing synergist is a promoter of the process of the invention, and it contains a form of halogen. Representative examples of inorganic synergists include those such as boron trichloride, boron tribromide, boron triiodide, aluminum trichloride, aluminum tribromide, aluminum triiodide, gallium trichloride, gallium tribromide, gallium triiodide, indium trichloride, indium tribromide, indium triiodide, transition metal halides, and so forth. Preferred are Group IIIB (American System) trihalides of the Periodic Table, that is, the boron group halides. Preferred halides herein, separately at each occurrence, include chlorides, bromides and/or iodides, especially chlorides. The most preferred residual halogen containing synergist is aluminum trichloride.

The minor amount of the residual halogen containing synergist(s) can vary, but for the most part, the amount is generally small, for instance, from above zero normal in the residual halogen, for example, halide, to about one normal in the residual halogen. For example, 0.33 M (molar) aluminum trichloride is about 1N (normal) in the residual halogen, chloride. More preferably, the normality of the residual halogen in said synergist ranges from about 0.1N to 0.8N, even more so from about 0.3N to 0.5N. More specifically, the minor amount of said synergist, for instance, such as the boron group trihalide such as, for example, aluminum trichloride, preferably resides from about 0.05M to 0.25M, and even more so from about 0.10M to 0.15M. Greater amounts of such a trihalide, for example, aluminum trichloride, are typically avoided because they may cause undesired precipitates to form, and lesser amounts than these minor amounts of such a trihalide, such as under the lowest ends of the numerically defined ranges, may not as efficiently promote the process of the invention.

The residual alkaline earth metal is also one of the required solute components. The residual alkaline earth metal component can be an added solute such as an alkaline earth metal salt, an alkaline earth decomposition product of the sacrificial alkaline earth metal containing anode, or combination thereof.

The alkaline earth metal salt is preferable, such as a halide, a borate, organic halide, or combination thereof. Representative examples include those such as beryllium chloride, magnesium chloride, magnesium iodide, magnesium borohydride, magnesium tetrafluoroborate, calcium chloride, strontium chloride, strontium tetrachloroborate, barium chloride, barium tetrabromoborate, ethyl magnesium chloride, and so forth, preferred are $C_{1-10}$ (from one to about ten carbon) alkyl or arenyl magnesium halides, especially the alkyl, and more so $C_{1-16}$ (from one to about six carbon) alkyl, magnesium halides, particularly chlorides. The most preferred alkaline earth metal salts are ethylmagnesium chloride (EtMgCl) and n-butylmagnesium chloride (BuMgCl). Methylmagnesium chloride (MeMgCl) is more reactive in air than EtMgCl and BuMgCl. Slightly higher voltages may be required with BuMgCl than EtMgCl, but the Mg deposits with BuMgCl are typically of a more consistently high quality. The EtMgCl is more reactive in air than BuMgCl.

The major amounts of the alkaline earth metal salt which are employed are those amounts which are greater than said synergist and which are operable in the electrochemical cell of the process of the invention. Preferably, the major amount of the alkaline earth metal salt which is employed is at least about three times the amount of said snyergist, with these amounts based on number of moles of the alkaline earth metal salt to number of molar equivalents of residual halogen of said synergist. For example, nine moles of ethylmagnesium chloride and one mole of aluminum trichloride provide the 3:1 ratio amount. Most preferably, the ratio of moles of the alkaline earth metal salt to number of molar equivalents of residual halogen of said synergist is from about 3.3:1 to 7:1. Lower amounts than the foregoing, especially the 3:1 ratio, may also result in undesired precipitation. Too high an amount of the salt component(s) may also result in undesired precipitation. In terms of molar amounts of the alkaline earth metal salt, from about 0.5M to about 2.5M is preferred and from about 0.8M to about 2.0M is most preferred.

The electrolyte is generally liquid. Preferably, the electrochemical cell of the process of the invention is operated with a homogeneous electrolyte. The electrochemical cell is preferably operable such as a secondary (rechargeable) battery.

The cathode contains the conductive substrate. Representative examples of the cathode include pure alkaline earth metal—Be, Mg, Ca, Sr, Ba, Ra, and also aluminum (Al), copper (Cu), iron (Fe) and alloys such as steel, and so forth. Preferred are Al, Cu, Fe and steel, most especially Al.

Other conditions, and parameters, of operating the electochemical cell of the process of the invention are those which are sufficient to carry out said electrodeposition, as well. The other conditions include temperature, pressure, cell voltage, current density and time. Optimums for each in any given instance are readily determinable by those skilled in the art.

The temperature generally resides between the freezing and boiling points of the electrolyte. Preferred temperatures include those from about minus 120° C. to about plus 80° C., more preferably from about minus 110° C. to about plus 65° C., even more so from about plus 15° C. to about plus 40° C.

The pressure can generally be supra- to subatmospheric, so long as the electrolyte remains generally liquid. Preferably, the pressure is ambient, for example, as atmospheric pressure (about 95 kPa to about 105 kPa).

The cell voltage is generally applied at a value of at most about 10 volts (V), especially with an anode such as the passive anode. More specifically, the applied voltage preferably is at most about 4 V, with from about 3 V to 4 V being more preferred with the passive anodes and with from about 0.4 V to 3 V being more preferred with the sacrificial alkaline earth metal containing anodes.

The current density is generally any up to the limiting current density for the electrochemical cell employed. Too high a current density, as well as too high a cell voltage, may cause undesired decomposition which may include electrolyte decomposition. Preferably, current densities are generally from about 1 to 10 milliamps per square centimeter ($mA/cm^2$), more preferably from about 5 to 10 $mA/cm^2$.

The time (duration) which the process of the invention is carried out can vary widely, as appropriate to the conditions and parameters, and as desired. In general, the longer the process is carried out, the greater is the amount of high purity metallic containing alkaline earth metal which is electrodeposited. Times from several minutes to several days or appreciably longer can be advantageously employed, as appropriate and desired. Replenishment of starting materials can extend the time, even into such as a continuous process.

Any appropriate cell vessel may be employed in the process of the invention. See, e.g., McIntyre et al., U.S. Pat. No. 4,187,350 (1980) (incorporated herein by reference). A preferred cell size is from about 250 milliliters (mL) to about 4 liters (L). Most preferably mixing is carried out during the process, for example, with a magnetic stirring bar which is coated with polytetrafluoroethylene.

The high purity metallic containing alkaline earth metal can be collected by procedures well known to any person skilled in the art. Similarly, use of the high purity metallic containing alkaline earth metal can be accomplished by procedures well known to any person skilled in the art.

The following representative examples further illustrate the invention. Parts and percentages are by weight unless otherwise specified.

EXAMPLE 1

Passive Anode

Run A: Under a dry nitrogen atmosphere, a 20 mL sample of a solution of 1.00M aluminum trichloride in dry THF is slowly added dropwise, with stirring, to a 180 mL sample of a solution of 2.0M EtMgCl in dry THF. The resulting solution is transferred thereunder to a dry electrolytic cell having a graphite anode and a Cu sheet cathode, and the solution is purged with argon gas for 20 minutes. An applied voltage of about 4V is maintained at a current density of 3.000 $mA/cm^2$ until 230.0 coulombs are passed therethrough. The Cu disc gains 0.0250 g of essentially pure, non-dendritic (dendrites indicating possibly higher levels of impurities) crystalline, very bright Mg metal. Current efficiency at the cathode (CCE) is 86.3 percent.

Run B: The procedure of the foregoing Run A is substantially repeated, except that a small amount of anhydrous magnesium chloride is also added to the solution, and the Argon gas purge is carried out for 15 minutes. The Mg metal deposit is essentially equivalent to the Mg metal deposit of the foregoing Run A. The CCE is 75.3 percent.

EXAMPLE 2

Sacrificial Anode

Run C: A 200 mL sample of a THF solution 1.0M in EtMgCl and 0.1M in aluminum trichloride is prepared by the general procedure of the foregoing Run A of Example 1, and the sample is similarly placed into a dry electrolytic cell. The cell contains a Cu sheet cathode and a magnesium alloy anode containing a nominal 1 weight percent manganese and in excess of 98 weight percent magnesium. The anode contains Mg and molybdenum (Mo), Fe, manganese (Mn), Al and chromium (Cr). A voltage of about 0.6 V is applied (Appl. V) with a current density of 1.000 $mA/cm^2$ until 234.3 coulombs are passed. Upon completion of the passing of the current, the anode has a brassy cast which may be due to a resulting Mn to Mg ratio therein which is greater than is observed initially because of apparent selective electrodissolution of Mg initially present therein. The Mg metal which is deposited onto the cathode is highly pure. Elemental analysis shows Cu (from cathode): $90\pm20$ parts part million (ppm); Mo: $8\pm3$ ppm; Mn: $13\pm4$ ppm; Fe: $60\pm10$ ppm; Al: $30\pm10$ ppm; Cr: $5\pm2$ ppm. Although some residual salt is also present as is indicated by the amount of chlorine which is seen in EDS (Energy Dispersive X-Ray Spectroscopy) spectra, the Mn and Fe regions in the EDS spectra are no more intense than those of the surrounding background. Scanning electron micrographs of the Mg metal electrodeposit show generally well-defined regular crystals which may reveal seven visible facets and, as if completely generally regular, such as of a regular hexagonal base pyramid having the seventh (top) facet generally parallel to, but of smaller dimensions than, the generally regular hexagonal base. Measured anode current efficiency (ACE) is 100 percent, and the CCE is 102 percent.

Run D: A run similar to the foregoing Run C is carried out. The Mg metal which is deposited is also highly pure. Elemental analysis shows Cu (from cathode): $200\pm30$ ppm; Mo: $13\pm5$ ppm; Mn: $40\pm10$ ppm; Fe: $55\pm10$ ppm; Al: $51\pm10$ ppm; Cr: Not detectable at 2 ppm detection limit.

Run E: A run similar to the foregoing Run C is carried out except that the anode is AZ61A Mg alloy which contains Mg and Mo, Mn, Fe, Al, Zn and Cr; the cathode is an Al disc, and the cell voltage is applied initially at 1.2 V and rises slowly to 1.6 V at the completion of the Run which is stopped upon passing 90.0 coulombs. The electrodeposit consists essentially of pure Mg metal. The ACE is 83.0 percent, and the CCE is 95.3 percent.

Runs F–H: Runs similar to the foregoing Run C are carried out except that the anode is a Mg anode; the cathode is an Al disc, and the following is employed and is observed.

| Run | [EtMgCl] | [$AlCl_3$] | Appl. V | ACE | CCE |
|---|---|---|---|---|---|
| F | 0.8 M | 0.15 M | 0.9 V | 100% | 100% |
| G | 1.7 M | 0.15 M | 0.5 V | 98.8% | 104.4% |
| H | 2.0 M | 0.1 M | 0.6 V | 102% | 100% |

The Mg metal which is electrodeposited in each of Runs F through H is of excellent purity, consisting most essentially of pure Mg metal. The Mg deposit of Run F is highly crystalline with a small grain. The Mg deposit of Run G is highly crystalline with a very large grain. The Mg deposit of Run H is highly crystalline with a large grain.

Runs I & J: Runs similar to the foregoing Runs F–H are each carried out employing n-butylmagnesium chloride, and the following is also employed and is observed.

| Run | [BuMgCl] | [$AlCl_3$] | Appl. V | ACE | CCE |
|---|---|---|---|---|---|
| I | 1.0 M | 0.10 M | 0.9 to 3.5 V | 103.6% | 97.9% |
| J | 1.25 M | 0.05 M | 0.95 V | 103.6% | 98.4% |

The Mg metal which is electrodeposited in each of Runs I and J is of excellent purity, consisting most essentially of, if not consisting of, pure Mg metal. Each of the Mg deposits of Runs I and J is highly crystalline with a very small grain.

Many changes and modifications can readily be made and adapted in specifically altered embodiments in accordance with the present invention without substantially or materially departing from its apparent and intended spirit and scope, all in pursuance and accordance with same as it is set forth and defined in the hereto-appended Claims.

What is claimed is:

1. A process for electrodepositing a high purity metal consisting essentially of magnesium on a conductive substrate comprising operating an electrochemical cell having (1) a sacrificial magnesium anode;

(2) an electrolyte containing an aprotic solvent and a solute of a minor amount of residual halogen containing synergist and a major amount of residual alkaline earth metal, and (3) a cathode, which contains the conductive substrate, under conditions whereby said electrodepositing occurs.

2. The process of claim 1 wherein the anode is passive.

3. The process of claim 2 wherein the aprotic solvent is a $C_{1-20}$ ether.

4. The process of claim 3 wherein said synergist is a Group IIIB (American System) trihalide.

5. The process of claim 4 wherein the residual alkaline earth metal contains an alkaline earth metal salt selected from the group consisting of an alkaline earth metal halide, an alkaline earth metal borate and an alkaline earth metal organic halide.

6. The process of claim 5 wherein the aprotic solvent is a $C_{4-8}$ alkyl ether; said synergist is an aluminum trihalide present in a concentration from about 0.05M to about 0.25M; the residual alkaline earth metal contains a $C_{1-6}$ alkyl alkaline earth metal halide present in a concentration from about 0.5M to about 2.5M, and the magnesium consists essentially of pure Mg metal.

7. The process of claim 1 wherein the anode is sacrificial.

8. The process of claim 7 wherein the aprotic solvent is a $C_{1-20}$ ether.

9. The process of claim 8 wherein said synergist is a Group IIIB (American System) trihalide.

10. The process of claim 9 wherein the residual alkaline earth metal contains an alkaline earth metal organic halide.

11. The process of claim 10 wherein the aprotic solvent is a $C_{4-8}$ alkyl ether; said synergist is an aluminum trihalide present in a concentration from about 0.05M to about 0.25M, and the residual alkaline earth metal contains a $C_{1-6}$ alkyl alkaline earth metal halide present in a concentration from about 0.5M to about 2.5M.

12. The process of claim 11 wherein the aprotic solvent is tetrahydrofuran, and said synergist is aluminum trichloride.

13. The process of claim 1 wherein the magnesium is at least about 99 percent pure by weight.

14. The process of claim 1 wherein the magnesium is at least about 99.9 percent pure by weight.

15. The process of claim 14 wherein the anode is a sacrificial magnesium containing anode; the aprotic solvent is a $C_{4-8}$ alkyl ether; said synergist is aluminum trichloride present in a concentration from about 0.1M to about 0.15M, and the residual alkaline earth metal contains a $C_{1-6}$ alkylmagnesium chloride present in a concentration from about 0.8M to about 2.0M.

16. The process of claim 15 wherein the aprotic solvent is tetrahydrofuran, and voltage which is applied is applied from about 0.4 V to about 4 V, and current density is from about 1 $mA/cm^2$ to about 10 $mA/cm^2$.

17. The process of claim 1 for depositing said magnesium metal on a conductive substrate comprising operating an electrochemical cell having (1) a sacrificial magnesium alloy anode;

(2) an electrolyte initially containing 1.0M ethylmagnesium chloride and 0.1M aluminum trichloride in tetrahydrofuran, and (3) a copper cathode under an applied voltage of about 0.6 V with a current density of about 1 $mA/cm^2$.

18. The process of claim 1 wherein the electrodeposited magnesium is about 95% pure.

19. The process of claim 1 wherein the solvent is ether and the synergist consists essentially of aluminum trichloride.

* * * * *